United States Patent [19]

Swain et al.

[11] Patent Number: 4,981,775

[45] Date of Patent: Jan. 1, 1991

[54] PHOTOTHERMOGRAPHIC ELEMENTS

[75] Inventors: Steven Swain, Bishop's Stortford; Tran Van Thien; Stephen S. C. Poon, both of Harlow, all of England

[73] Assignee: Minnesota Mining and Manufacturing Company, St. Paul, Minn.

[21] Appl. No.: 372,007

[22] Filed: Jun. 26, 1989

[30] Foreign Application Priority Data

Jul. 4, 1988 [GB] United Kingdom ..... 8815829

[51] Int. Cl.[5] ..... G03C 8/10

[52] U.S. Cl. ..... 430/203; 430/223; 430/559

[58] Field of Search ..... 430/203, 223, 559, 203, 430/223, 599, 619

[56] References Cited

U.S. PATENT DOCUMENTS

| | | | |
|---|---|---|---|
| 4,021,240 | 5/1977 | Cerquone et al. | 430/203 |
| 4,022,617 | 5/1977 | McGuckin | 430/203 |
| 4,386,149 | 5/1983 | Mason et al. | 430/213 |

FOREIGN PATENT DOCUMENTS

| | | |
|---|---|---|
| 2100016A | 12/1982 | United Kingdom . |
| 2100458A | 12/1982 | United Kingdom . |

*Primary Examiner*—Paul R. Michl

*Assistant Examiner*—Janet C. Baxter

*Attorney, Agent, or Firm*—Donald M. Sell; Walter N. Kirn; Gregory A. Evearitt

[57] ABSTRACT

A photothermographic element comprising a support bearing an image forming system comprising:

(a) a photosensitive silver halide (b) an organic silver compound (c) a polymer binder and (d) a reducing agent for the organic silver compound, characterized in that the reducing agent comprises a redox-dye-releasing compound of the general formula:

in which:

R represents an organic group which may be oxidatively cleaved to a thermally immobile form, A represents a bond or a divalent linking group having a chain consisting of up to 12 atoms, which is linked to the carbonyl group via a carbon atom or an oxygen atom, and D represents the chromophore of a thermally mobile dye.

14 Claims, No Drawings

PHOTOTHERMOGRAPHIC ELEMENTS

FIELD OF THE INVENTION

This invention relates to photothermographic materials which form colour images upon light exposure and heat development. In particular, the invention relates to colour photothermographic materials containing redox-dye-releasing compounds which release a thermally mobile dye upon light exposure and heat development.

BACKGROUND OF THE INVENTION

Heat developable photographic materials and processes have been well known in the art for many years. Photosensitive, heat-developable, dry silver sheet materials, as described for example in U.S. Pat. Nos. 3,457,075 and 3,839,049, contain a photosensitive silver halide catalyst-forming means in catalytic proximity to a heat sensitive combination of a light stable organic silver compound and a reducing agent therefor. When struck by light, the silver halide catalyst-forming means produces silver nuclei which serve to catalyze the reduction of the organic silver compound, e.g., silver behenate, by the reducing agent at elevated temperatures.

A variety of processes for obtaining colour images have been proposed.

U.S. Pat. No. 4,021,240 discloses the use of sulphonamidophenol reducing agents and four equivalent photographic colour couplers in photothermographic emulsions to produce dye images.

U.S. Pat. No. 4,022,617 discloses the use of leuco dyes in photothermographic emulsions. The leuco dyes are oxidised to form a colour image during the heat development of the photothermographic element.

U.S. Pat. No. 3,531,286 discloses the use of photographic phenolic or active methylene colour couplers in photothermographic emulsions containing p-phenylenediamine developing agents to produce dye images.

British Pat. No. 2,100,458 discloses the use of sulphonamidophenol and sulphonamidonaphthol dye-releasing redox compounds which release a diffusible dye on heat development. Various other dye-releasing systems have been disclosed e.g. U.S. Pat. Nos. 4,060,420, 4,731,321, 4,088,469, 4,511,650 and 4,499,180, often involving thermal generation of a basic substance.

British Pat. No. 2,100,016 discloses the use of dye-releasing couplers which, in combination with a reducing agent, release a diffusible dye on heat development.

It is an object of the present invention to provide alternative heat developable colour photographic materials capable of providing clear, stable colour images.

SUMMARY OF THE INVENTION

According to the present invention there is provided a photothermographic element comprising a support bearing an image forming system comprising:

(a) a photosensitive silver halide
(b) an organic silver compound
(c) a polymer binder and
(d) a reducing agent for the organic silver compound, characterised in that the reducing agent comprises a redox-dye-releasing compound of the general formula:

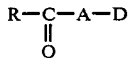

in which:

R represents an organic group which may be oxidatively cleaved to a thermally immobile form, A represents a bond or a divalent linking group having a chain length of up to 12 atoms, preferably less than 5 atoms, which is linked to the carbonyl group via a carbon atom or an oxygen atom, and D represents the chromophore of a thermally mobile dye.

The elements of the invention are capable of producing a silver image having a negative-positive relationship to the original and a thermally mobile dye in the part corresponding to the silver image at the same time, by simply carrying out heat development after imagewise exposure to light. After imagewise exposure to light, heating produces an oxidation-reduction reaction between the organic silver salt oxidising agent and/or silver halide and the redox-dye-releasing compound by means of exposed, photosensitive silver halide as a catalyst, to form a silver image in the exposed areas. In this reaction the redox-dye-releasing compound is oxidised by the organic silver salt oxidising agent and/or silver halide to form an oxidised product, with concomitant release of a thermally mobile dye. Accordingly, the silver image and the thermally mobile dye are obtained at the exposed area and a colour image is obtained by transferring the thermally mobile dye to an image receiving layer which may be present in the element or may be a separate sheet which is placed in contact with the element during heat development.

DETAILED DESCRIPTION OF THE INVENTION

The redox-dye-releasing compounds in the invention are of the formula:

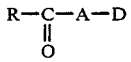

in which: R, A and D are as defined above

Preferably R represents a group having a nucleus of the formula

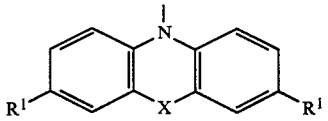

in which:

X represents O, S or $NR^2$ in which $R^2$ represents an optionally substituted alkyl or optionally substituted aryl group and each $R^1$ independently represents OH, $N(R^2)_2$, $NHCOR^2$ or $OCOR^2$.

$R^2$ generally contains from 1 to 20 carbon atoms. The alkyl and aryl groups may possess substituents e.g. alkyl, alkoxy, aryl, aryloxy, OH etc.

In addition to the substituents $R^1$, the rings may possess other substituents e.g. ballasting groups such as long chain and branded chain alkyl groups and polyether groups.

The R group provides the following properties to the redox-dye-releasing compound.

(a) it is rapidly oxidised by the organic silver salt oxidising agent in the presence of a latent image to effectively release a thermally mobile dye for image formation;

(b) it restricts the thermal mobility of the redox-dye-releaser and is itself thermally immobile in its oxidised form. (These properties can be enhanced by the use of suitable polymeric barrier layers.)

(c) it is stable to heat and does not release the image forming dye until it is oxidised.

Specific examples of groups include:

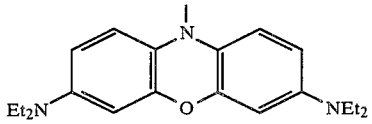

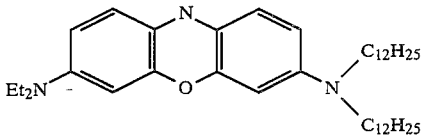

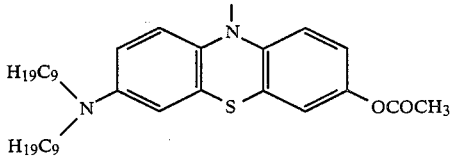

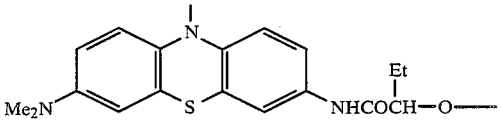

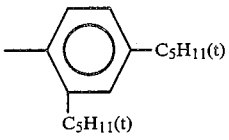

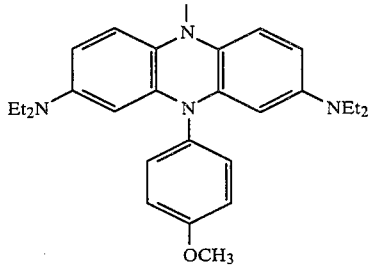

-continued

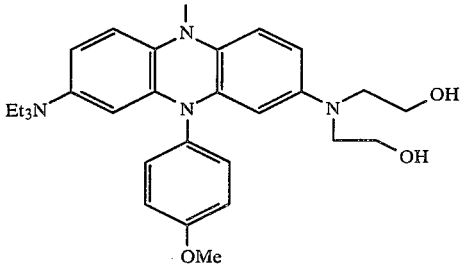

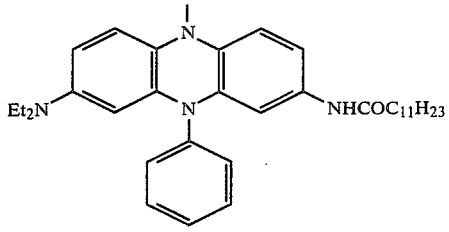

The chromophore D is released as a thermally mobile dye when the redox-dye-releasing compound is oxidatively cleaved during heat development. A thermally mobile dye is a dye which is capable of moving under the influence of heat, by diffusion through a polymeric binder and/or by sublimation across an air gap from its point of release to a receiving layer. Preferably the dye should become mobile within the temperature range 50° C. to 200° C., most preferably from 100° C. to 180° C.

Examples of dyes formed by D include azo dyes, anthraquinone dyes, naphthoquinone dyes, and benzylidene dyes.

The linking group A may be a bond or a divalent group having a short chain linked to the carbonyl group via a carbon or oxygen atom. Examples of linking groups include —O—, alkylene preferably of up to 6 carbon atoms, —O— alkylene preferably of up to 6 carbon atoms,

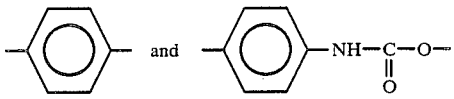

Desirable characteristics for the image forming dyes are as follows:

(a) excellent thermal mobility in the polymeric binder and through any polymeric barrier layers, whereby it is effectively transferred to an image receiving layer;

(b) good hue;

(c) a large molecular extinction coefficient;

(d) good fastness to heat and light.

Examples of chromophore D attached to linking group A include:

Yellow:

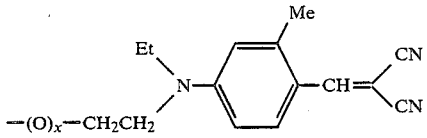

-continued
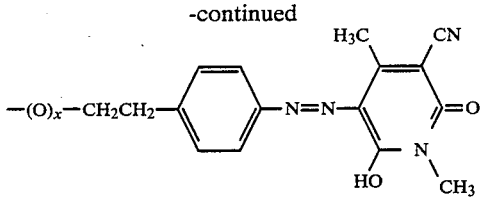
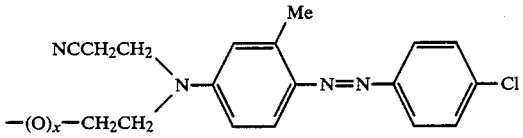
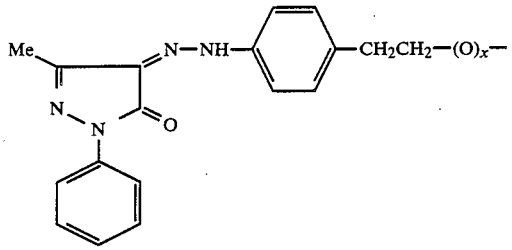
Magenta:
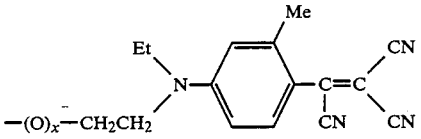
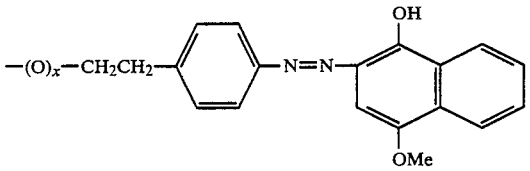
-continued
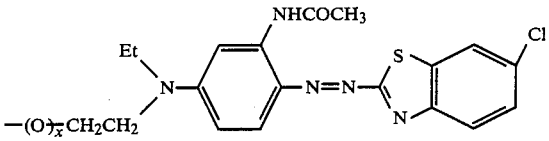
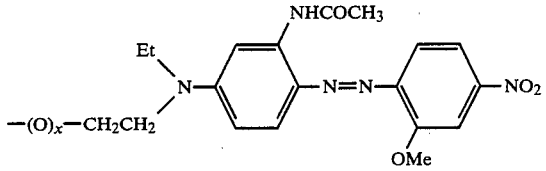
Cyan:
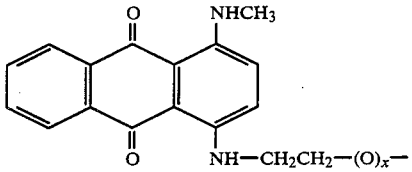
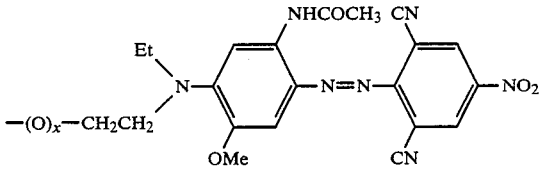
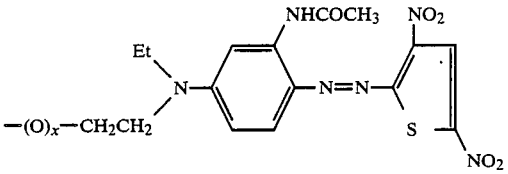
in which: x=0 or 1.
Examples of redox-dye-releasing compounds include:
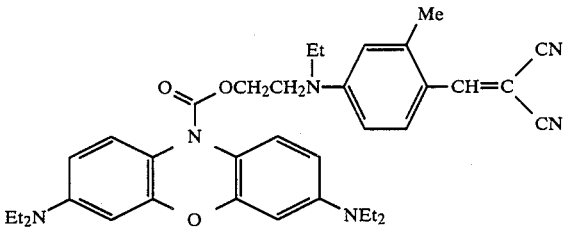
(1)
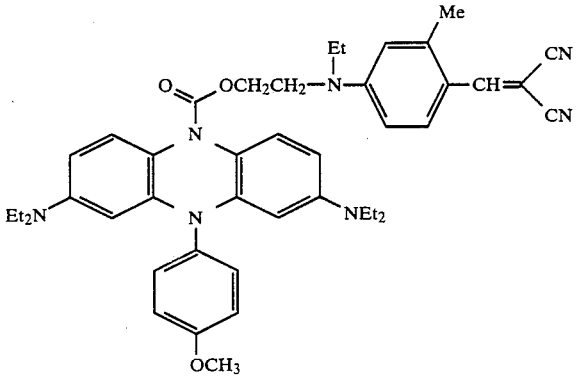
(2)

-continued
(3)
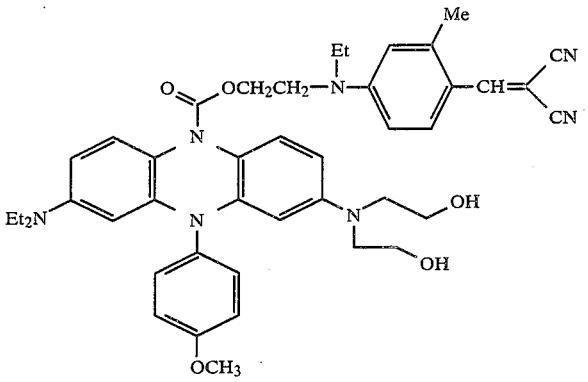
(4)
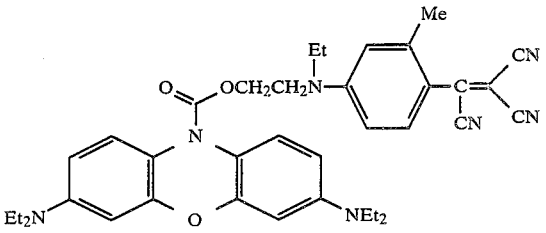
(5)
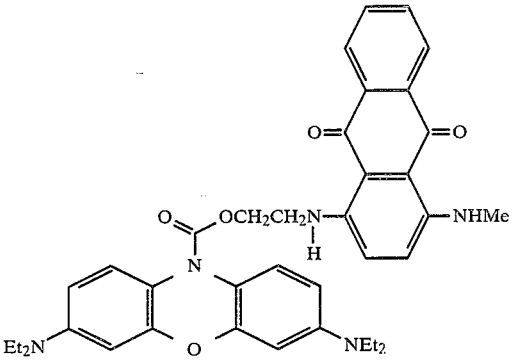
(6)
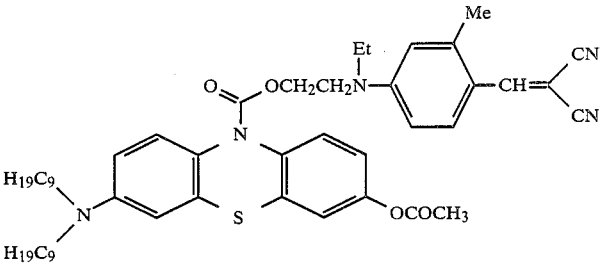
(7)
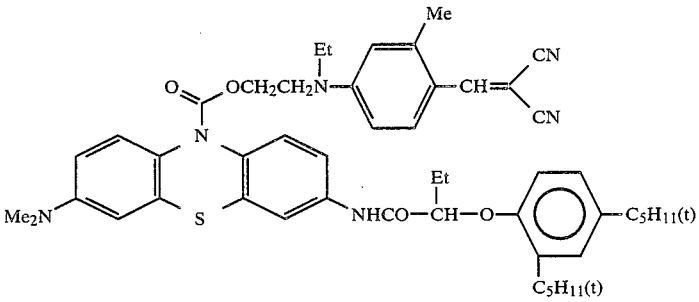

-continued (8)

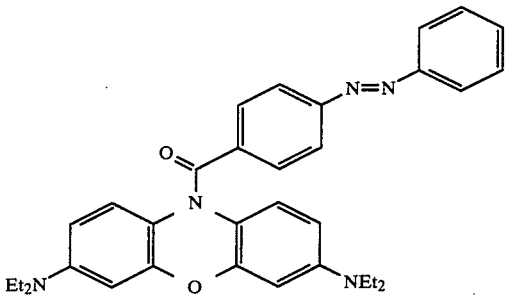

(9)

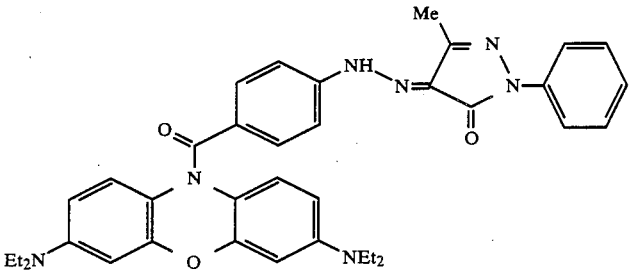

(10)

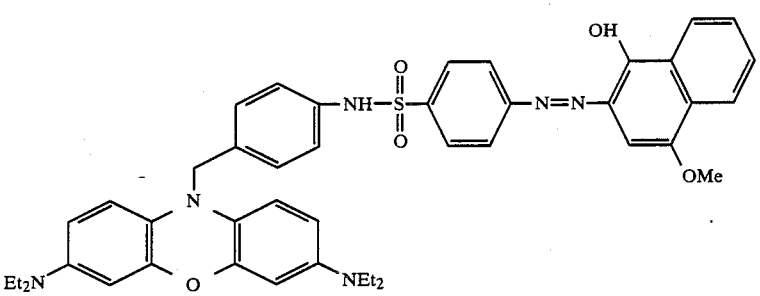

(11)

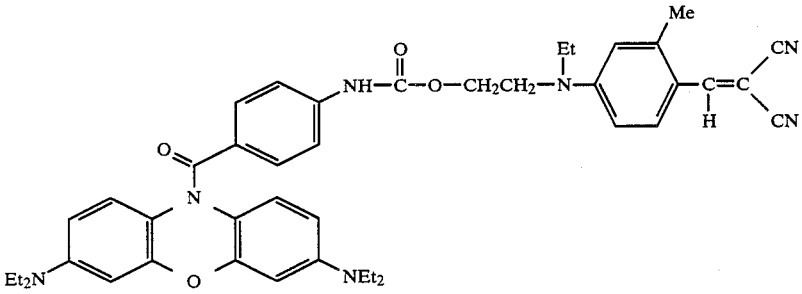

The redox-dye-releasing compound may be prepared by the following reaction schemes:

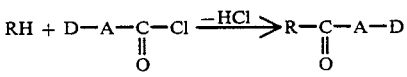

(1)

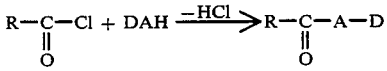

(2)

as will be exemplified in the Examples hereinafter.

The redox-dye-releasing compound is generally used in an amount of 0.01 mol to 4 mols per mol of the organic silver salt oxidising agent. A particularly suitable amount in the present invention is in the range of 0.05 to 1 mole per mol of organic silver salt oxidising agent.

The organic silver compound may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant for silver ion of between 4.0 and 10.0 are also useful. The organic silver material generally constitutes from 20 to 70 percent by weight of the imaging system. Preferably it is present as 30 to 55 percent by weight.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.01 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent. The silver halide used in the invention can be chemically and spectrally sensitised in a manner similar to the conventional wet process silver halide or state-of-the-art heat-developable photographic materials.

The polymeric binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers such as polyvinyl acetate/chloride are particularly desirable. The binders are generally used in a range of from 20 to 75 percent by weight of each layer, and preferably about 30 to 55 percent by weight.

To modify the development rate, development modifiers, present in a range of 0.01 to 10 weight percent of the coating solution can be used. Representative development modifiers include aromatic carboxylic acids and their anhydrides such as phthalic acid, 1,2,4-benzenetricarboxylic acid, and tetrachlorophthalic acid, 4-methylphthalic acid, phthalic anhydride, tetrachlorophthalic anhydride and the like.

Toners such as phthalazinone, and both phthalazine and phthalic acid, or derivatives thereof and toners known in the art may also be present in amounts from 0.01 to 10 percent by weight of the imaging layer. The photothermographic element can also include coating aids such as fluoroaliphatic polyesters.

This silver-coating solution may be either directly coated onto the support base as is conventional in the art, or alternatively it may be spray-dried to produce solid particles which may then be redispersed in a second, possibly different, polymeric binder and then coated onto the support base.

Polymeric barrier layers may also be present in the photothermographic elements of the present invention. The polymers are selected from well known natural and synthetic polymers such as gelatin, polyvinylalcohols, polyacrylic acids, sulphonated polystyrene and the like. The polymers may be optionally blended with barrier aids such as silica.

The image receiving layer can be any thermoplastic resin-containing layer capable of adsorbing and retaining the dye. The resin acts as a dye mordant. Preferred resins include polyesters, cellulosics, polyvinyl acetate and the like.

Preferably, the image receiving layer is coated adjacent to the heat-developable photosensitive layer. This facilitates thermal transfer of the image dye which is released when the imagewise exposed, photosensitive layer is subject to thermal treatment. Alternatively the dye released in the heat developable photosensitive layer can be thermally transferred to a separately coated image-receiving sheet by placing the exposed heat-developable photosensitive layer in intimate face-to-face contact with the image-receiving sheet and heating the resulting composite construction.

Development conditions will vary, depending on the construction used, but will typically involve heating the image-wise exposed material at a suitably elevated temperature, e.g. in the range 80° to 250° C., preferably in the range 120° to 200° C., for a fixed period of time, generally between 1 second and 2 minutes.

The support base of the photothermographic imageable element, as well as the image receiving element can be any supporting material such as paper, polymeric film, glass or metal.

The material of this invention can be applied, for example, in conventional colour photography, in electronically generated colour hardcopy recording and in digital colour proofing for the graphic arts area because of high photographic speed, the pure dye images produced, and the dry and rapid process provided.

The invention will now be illustrated by the following Examples in which the following components were used:

| | |
|---|---|
| Fluorocarbon FC 430 | a fluorinated surfactant commercially available from 3M |
| Butvar | poly (vinyl butyral) commercially available from Monsanto |
| Hi-Sil 422 | silica powder commercially available from PPG Industries Inc. |
| VYNS | vinyl chloride/vinyl acetate copolymer commercially available from Union Carbide |
| Aerosil 200 | silica powder commercially available from Degussa |

Dye A

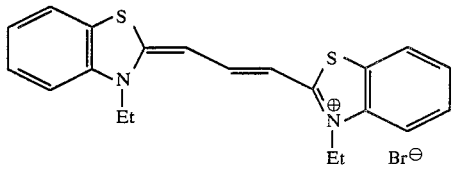

Dye B

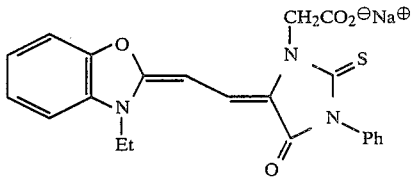

EXAMPLE 1

Synthesis of Redox-Dye-Releaser (1)

(1a) Preparation of

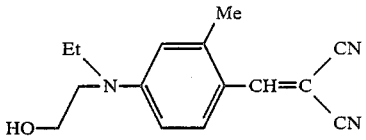

The yellow benzylidene dye was prepared by base-catalysed condensation of malononitrile with the appropriate aldehyde. The aldehyde was prepared by Vilsmeier formylation of the appropriate aniline derivative.

(1b) Synthesis of [[4-[ethyl(2-hydroxyethyl)amino]2-methylphenyl]methylene]propanedinitrile, chloroformate The yellow dye [[4-[ethyl(2-hydroxyethyl)amino]2-methylphenyl]methylene]propanedinitrile (2.55 g; 0.01 mole) was dissolved in $CH_2Cl_2$ (70 ml) and phosgene in toluene (12.5% w/w solution; 16 g; 0.02 mole) was added. After 2 hours stirring at room temperature, the solvent was evaporated and the residue recrystallised from $CH_2Cl_2$- ether to give 3.0 g of the chloroformate as yellow leaflets.

(1c) Synthesis of redox-dye-releaser (1)

Basic Blue 3 (Aldrich Chem. Co., 85% pure; 12.7 g; 0.03 mole) was dissolved in water (200 ml) and dichloromethane (200 ml) was added to form a two phase mixture. The mixture was gently stirred under nitrogen gas and the pH adjusted to 10 with 40% NaOH solution. Sodium dithionite (85% pure; 6.75 g; 0.033 mole) in water (100 ml) was added and the mixture stirred for 10 minutes as decolourisation took place. The pH was readjusted to pH 6 and a solution of 1b (7.7 g, 0.03 mole) in $CH_2Cl_2$ (100 ml) was then added in one portion. The mixture was stirred for 2½ hours, the pH being continually adjusted to pH 6 with 40% NaOH solution, and then the pH was raised to pH 10 and the whole mixture filtered through a shallow plug of Hyflo Supercel filter aid (supplied by BDH Ltd.). The layers of the filtrate were separated and the organic portion washed with brine, separated and dried over $MgSO_4$. Silica gel 60 (10 g) was added to the dried solution and the filtered solution was then concentrated to dryness to yield a yellow-brown foamy solid, 15.90 g. The solid was triturated with boiling isopropanol (250 ml) and the extract allowed to cool. The yellow crystals were collected, washed with isopropanol and dried to give 14.24 g of redox-dye-releasing compound (1).

infra-red spectrum ($CHCl_3$ solution): 2222 $cm^{-1}$ (C≡N), $1700^{-1}$ (O—CO—N).

EXAMPLE 2

Synthesis of Redox-Dye-Releaser (5)

1-Methylamino-4-hydroxyethylamino anthraquinone (1.48 g; 0.005 mole) was suspended in dry dioxan (100 ml) and triethylamine (2 ml) and 4-N,N-Dimethylaminopyridine (0.2 g) added. 3,7-bis(Diethylamino)-10-chloroformyl phenoxazine (prepared in accordance with Japanese Patent Application No. 57-80454) 1.94 g; 0.005 mole) in dioxan (25 ml) was then added dropwise and the mixture refluxed for 22 hours under nitrogen. The cooled mixture was poured into 500 ml of ice/water and then saturated with sodium chloride. The mixture was extracted with ethylacetate, the organic solution dried ($MgSO_4$) and evaporated to a blue solid. This material was flash chromatographed on silica gel, eluting with 5% ethylacetate in dichloromethane. On concentration the eluate gave 1.10 g of redox-dye-releasing compound (5).

infra-red spectrum ($CHCl_3$ solution) 1700 $cm^{-1}$ (O—CO—N).

EXAMPLE 3

Synthesis of Redox-Dye-Releaser (4)

(a) Preparation of

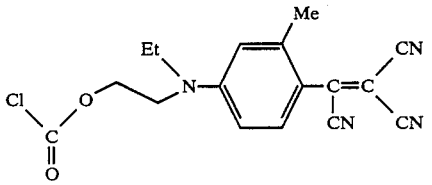

Sodium Cyanide (2.5 g, 0.05 mole) in $H_2O$ (5 ml) was added to a solution of the yellow benzylidene dye of Example 1(a) (12.7 g 0.05 mole) in dimethylformamide (DMF) (50 ml) and stirred at room temperature for 20 minutes. Bromine (80 g, 0.05 mole) in acetic acid (10 ml) was added dropwise over 20 minutes with cooling. After stirring for 1 hour at room temperature, the mixture was poured into 500 ml ice water and neutralised with sodium carbonate solution. The resulting oil was allowed to settle, isolated by decantation, then triturated 5 times with water with settling and decantation. Finally, the oil was dissolved in $CH_2Cl_2$, extracted with brine, dried ($MgSO_4$) and evaporated.

This crude product was dissolved in 25 ml ($CH_2Cl_2$), cooled in ice, and treated over 10 minutes with 70 ml of 12% solution of phosgene in toluene, then left overnight at room temperature. The filtered solution was evaporated to an oil, which was triturated with petroleum ether (4×100 ml) and dried under vacuum. Yield 10.1 g magenta oil.

(b) Preparation of Redox-Dye-Releaser (4)

11.85 (0.028 mole) Basic Blue 3 was converted to the leuco form as described in Example 1, using 9.1 g (0.045 mole) sodium dithionite. It was then reacted with the magenta chloroformate (10.0 g, 0.029 mole) following the procedure of Example 1. The crude product was purified by flash chromatography on silica gel with 2.5% ethyl acetate in $CH_2Cl_2$. Yield 7.26 g.

EXAMPLE 4

Synthesis of Redox-Dye-Releaser (9)

(a) Preparation of

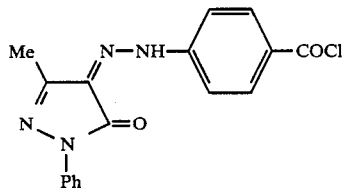

A solution of sodium nitrite (7.0 g) in water (50 ml) was added dropwise at 5° C. to a stirred mixture of 4-aminobenzoic acid (13.7 g), water (80 ml) and conc. HCl (22 ml). After stirring a further 20 minutes at 5° C. this solution was added over approximately 5 minutes to stirred solution of 3-methyl-1-phenyl-5-pyrazolone (17.4 g) and sodium carbonate (25 g) in 500 ml ice water. After a further 10 minutes stirring, the pH was adjusted to 7 and the orange precipitate filtered off, stirred with 500 ml methanol, filtered and dried at 55° C. in vacuum. Yield 25.5 g.

8.5 of this material was stirred under reflux with 6.0 g anhydrous sodium carbonate and 50 ml thionyl chloride for 1 hour. Excess thionyl chloride was evaporated and the residue extracted with 200 ml $CH_2Cl_2$, filtered and evaporated, leaving 7.8 g of the desired acid chloride.

(b) Preparation of Redox-Dye-Releaser (9)

6.3 g (0.015 mole) Basic Blue 3 was converted to the leuco form as described in Example 1, using 3.4 g (0.015 mole) sodium dithionite, then reacted with 5.6 g (0.016 mole) of the acid chloride using the method of Example 1. The crude product was purified by flash chromatography over silica gel, eluting with 5% ethyl acetate in $CH_2Cl_2$. Yield 4.6 g brown solid.

EXAMPLE 5

For use on paper or other non-transparent backings it is found convenient to use silver half-soaps, of which an equimolar blend of silver behenate and behenic acid, prepared by precipitation from aqueous solution of the sodium salt of commercial behenic acid and containing about 14.5 percent silver, represents a preferred example.

A silver soap first trip was prepared with the following ingredients:

| | |
|---|---|
| Silver behenate halidised ½ soap | 100 g |
| Fluorocarbon FC430 | 0.6 g |
| Dimethyl formamide | 10 ml |
| Mercuric acetate | 0.5 g |

A second trip was prepared with the following ingredients

| | |
|---|---|
| Redox-Dye-Releaser (1) | 0.3 g |
| Dimethylformamide | 6 ml |
| $Me_2NSO_2NH_2$ | 0.3 g |
| Tetrachlorophthalic acid | 0.1 g |
| Tetrachlorophthalic anhydride | 0.1 g |
| Phthalic acid | 0.8 g |
| Butvar (15% in 2-Butanone) | 15 g |
| Silica Hi-Sil 422 | 1.5 g |
| Fluorocarbon FC430 | 0.3 g |

The first trip was coated onto vesicular white polyester base at 50 μm wet thickness and dried at 70° C. for 3 minutes. This was then overcoated with second trip at 50 μm wet thickness and dried at 70° C. for 3 minutes to give the photosensitive layer.

A 10% solution of VYNS (vinyl chloride/acetate copolymer) and Hi-Sil 422 silica in 2-butanone was ball-milled for 72 hours and coated at 50 μm wet thickness onto paper base. Drying at 70° C. for 3 minutes gave the image receiving layer.

The photosensitive layer was imagewise exposed in a 3M Model "179" contact printer/processor for ten seconds. The imaged sheet was then sandwiched together with the image receiving layer, with their coated sides together, and heat developed with the photosensitive sheet in contact with the heated surface of a heat densitometer for twenty seconds. After cooling, the image receiving layer was stripped apart from the photosensitive layer. A clear yellow transferred negative image was obtained on the image receiving layer, showing the following sensitometric properties.

| Development Temperature/°C. | 200 | 190 | 180 | 170 | 160 | 150 | 140 |
|---|---|---|---|---|---|---|---|
| $D_{min}$ | 0.11 | 0.09 | 0.07 | 0.05 | 0.03 | 0.02 | 0.01 |
| $D_{max}$ (to blue light) | 0.49 | 0.49 | 0.42 | 0.30 | 0.16 | 0.08 | 0.03 |

EXAMPLE 6

Premix

| | |
|---|---|
| Silver behenate half soap homogenate | 180 g |
| Toluene | 69 g |
| Mercuric bromide (10% w/v in methanol) | 3 ml |
| Butvar B76 | 16 g |
| Dye A (2% w/v in methanol) | 3 ml |
| Dye B (1% w/v in methanol) | 3 ml |

Image forming layer (Trip 2)

| | |
|---|---|
| Premix | 5 g |
| Aerosil 200 | 0.5 g |
| Aerosil was dispersed by high speed stirring until increase in viscosity obtained. | |
| Redox-Dye-Releaser (4) | 0.1 g |
| Tetrachlorophthalic acid | 0.33 g |
| Tetrachlorophthalic anhydride | 0.33 g |
| Phthalic acid | 0.2 g |

Underlayer (Trip 1)

| | |
|---|---|
| Acetone | 3 g |
| Toluene | 3 g |
| VYNS | 0.8 g |
| Aerosil 200 | 0.1 g |
| Subjected to high speed stirring until viscosity increased. | |

Trip 1 was coated at 50 μm wet thickness on gelatin subbed clear polyester film base and dried at 70° C. for 3 minutes. Trip 2 was coated on trip 1 at 75 μm wet thickness and dried at 70° C. for 3 minutes.

A strip from the coated sheet was imagewise exposed to a 100W incandescent lamp at a distance of 6 inches for 20 seconds then placed in contact with a strip of opaque white unsubbed polyester film base. The combination was held under tension with the photosensitive sheet in contact with a curved metal surface at 170° C. for 30 seconds. After cooling the sheets were separated and the white polyester sheet had a magenta image $D_{max}$ 0.3, $D_{min}$ 0.1 (measured with green light).

EXAMPLE 7

| | |
|---|---|
| Image forming layer (Trip 2) | |
| Premix of Example 6 | 2.5 g |
| Redox-Dye-Releaser (9) | 0.035 g |
| Phthalic Acid | 0.035 g |
| Underlayer (Trip 1) | |
| As in Example 6. | |

Trip 1 was coated at 50 μm wet thickness on gelatin-subbed clear polyester film base and dried at 70° C. for 3 minutes. Trip 2 was coated on Trip 1 at 75 μm wet thickness and dried similarly.

A strip from the sheet was exposed and processed as in Example 6 except that heating was at 140° C. for 10 seconds. The white polyester sheet had a greenish-yellow image $D_{max}$ 0.3, $D_{min}$ 0.05 (measured with blue light).

What we claim is:

1. A photothermographic element comprising a support bearing an image forming system comprising:

(a) a photosensitive silver halide (b) an organic silver compound (c) a polymer binder and (d) a reducing agent for the organic silver compound, characterised in that the reducing agent comprises a redox-dye-releasing compound of the general formula:

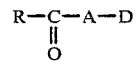

in which:

R represents an organic group which is oxidatively cleaved by the reduction of said silver halide and/or said organic silver compound during heat development to release a thermally mobile dye, A represents a bond or a divalent linking group having a chain consisting of up to 12 atoms, which is linked to the carbonyl group via a carbon atom or an oxygen atom, and D represents the chromophore of a thermally mobile dye.

2. An element as claimed in claim 1 characterised in that R represents a group having a nucleus of the formula:

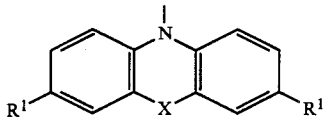

in which:

X represents O, S or $NR^2$ in which $R^2$ represents an optionally substituted alkyl or aryl group, and each $R^1$ independently represents OH, $N(R^2)_2$, $NHCOR^2$ or $OCOR^2$.

3. An element as claimed in claim 2 characterised in that R represents a group having a nucleus selected from

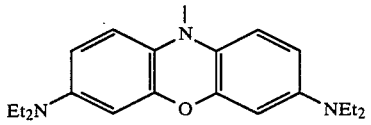

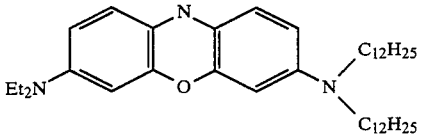

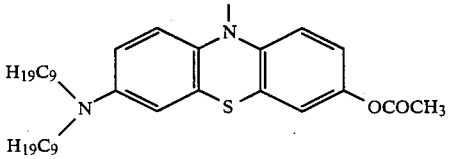

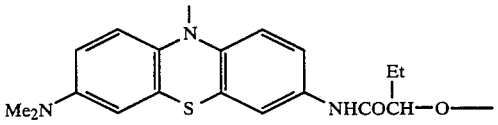

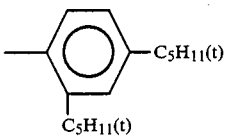

-continued

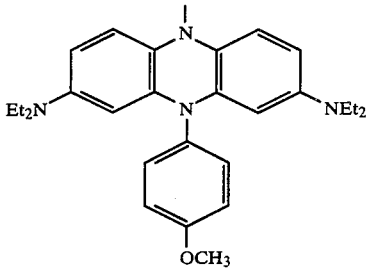

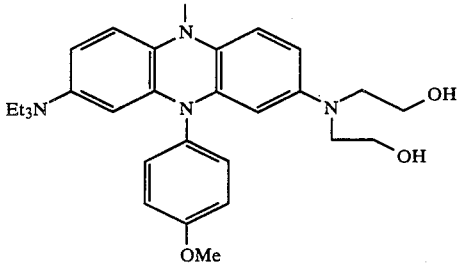

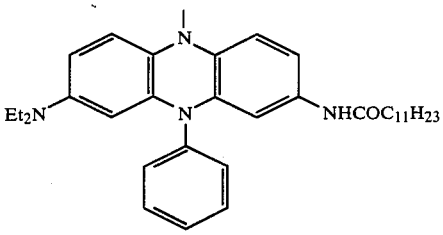

4. An element as claimed in claim 2 characterised in that D is derived from an azo, anthraquinone, naphthaquinone or benzylidene dye.

5. An element as claimed in claim 4 characterised in that D—A— represents

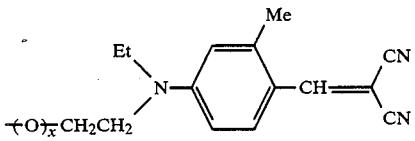

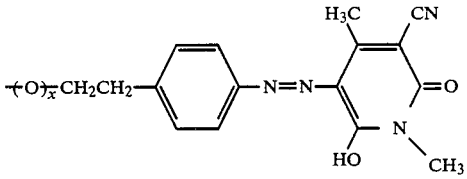

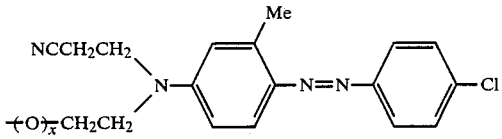

-continued
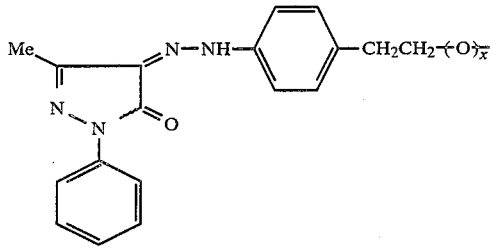
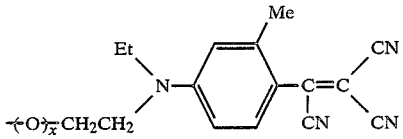
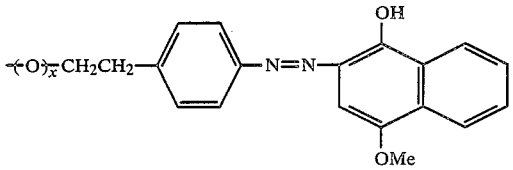
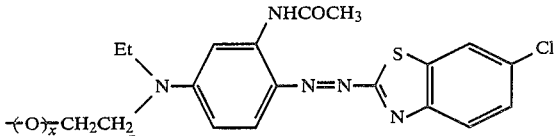
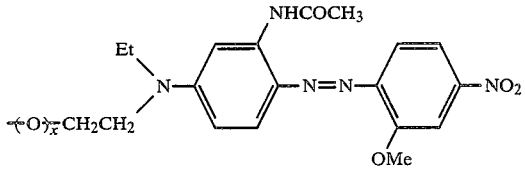
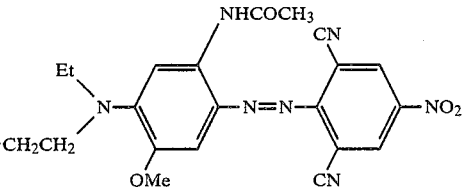
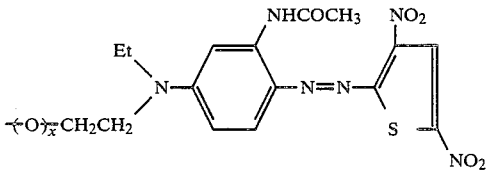
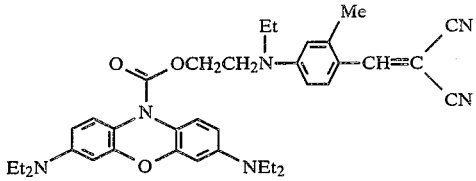
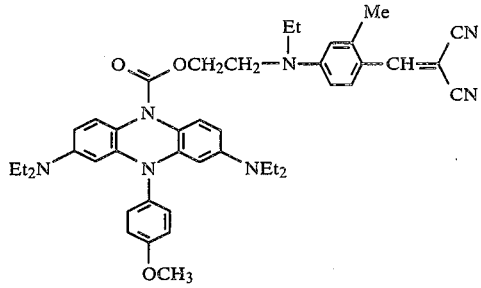
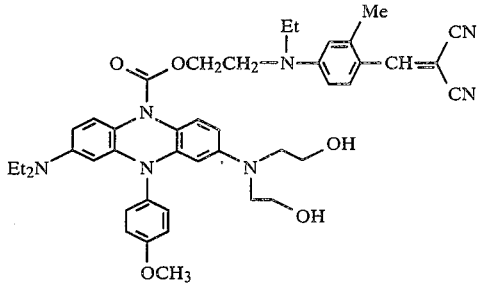
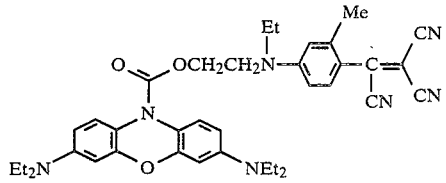
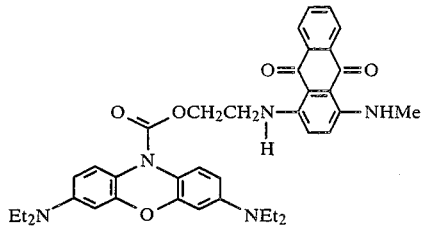
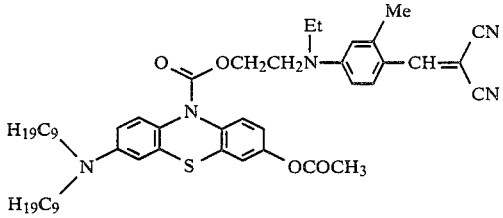
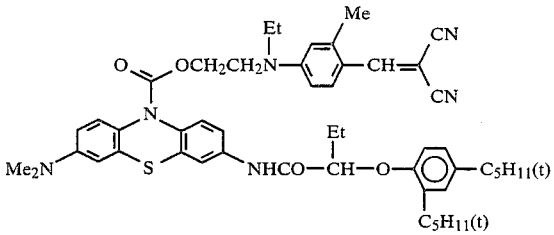
in which: x is 0 or 1.
6. An element as claimed in claim 2 characterised in that the redox-dye-releasing compound is selected from:

-continued

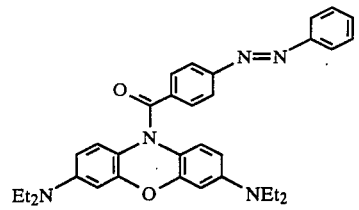

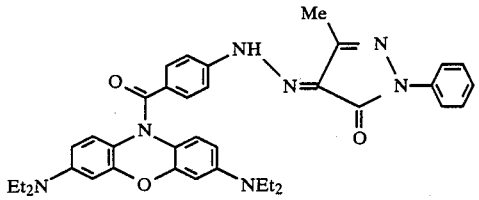

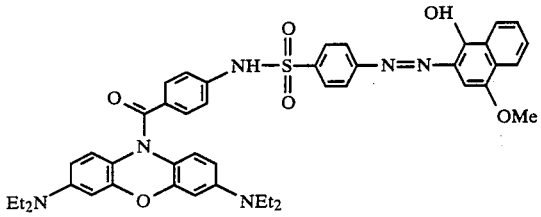

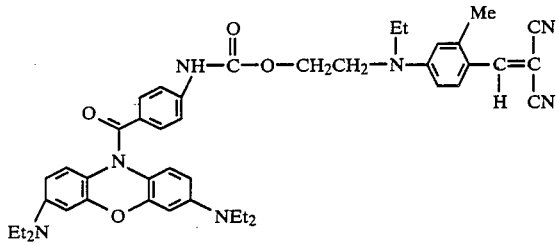

7. An element as claimed in claim 2 characterised in that it additionally comprises an image receiving layer capable of absorbing and retaining dye released from the redox-dye-releasing compound.

8. An element as claimed in claim 7 characterised in that the image receiving layer comprises a thermoplastic resin.

9. A method of producing an image which comprises image-wise exposing an element as claimed in claim 1 and thereafter heating the element to a sufficient temperature for sufficient time to develop the image.

10. A method as claimed in claim 9 characterised in that the element does not possess an image receiving layer and the element is placed in contact with an image receiving sheet during development and thereafter the image receiving sheet is stripped from said element.

11. A photothermographic element comprising a support bearing an image forming system consisting essentially of:

(a) a photosensitive silver halide
(b) an organic silver compound
(c) a polymer binder and
(d) a reducing agent for the organic silver compound, characterised in that the reducing agent consisting essentially of a redox-dye-releasing compound of the general formula:

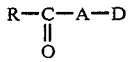

in which:

R represents an organic group which is oxidatively cleaved by the reduction of said silver halide and/or said organic silver compound during heat development to release a thermally mobile dye, A represents a bond or a divalent linking group having a chain consisting of up to 12 atoms, which is linked to the carbonyl group via a carbon atom or an oxygen atom, and D represents the chromophore of a thermally mobile dye.

12. A photothermographic element according to claim 11 wherein R represents a group having a nucleus of the formula:

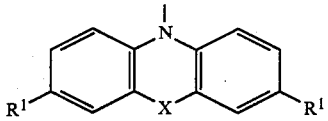

in which:

X represents O, S or $NR^2$ in which $R^2$ represents an optionally substituted alkyl or aryl group, and each $R^1$ independently represents OH, $N(R^2)_2$, $NHCOR^2$ or $OCOR^2$.

13. A photothermographic element comprising a support bearing an image forming system comprising:

(a) a photosensitive silver halide
(b) an organic silver compound
(c) a polymer binder and
(d) a reducing agent for the organic silver compound, characterised in that the reducing agent comprises a redox-dye-releasing compound of the general formula:

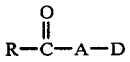

in which:

R represents an organic group which is oxidatively cleaved through a redox reaction between said R group and said silver halide and/or said organic silver compound during heat development to release a thermally mobile dye, A represents a bond or a divalent linking group having a chain consisting of up to 12 atoms, which is linked to the carbonyl group via a carbon atom or an oxygen atom, and D represents the chromophore of a thermally mobile dye which is released upon oxidative cleavage of said R group.

14. A photothermographic element according to claim 13 wherein R represents a group having a nucleus of the formula:

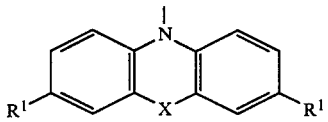

in which:

X represents O, S or $NR^2$ in which $R^2$ represents an optionally substituted alkyl or aryl group, and each $R^1$ independently represents OH, $N(R^2)_2$, $NHCOR^2$ or $OCOR^2$.

* * * * *